US006186438B1

(12) United States Patent
Zeppenfeld et al.

(10) Patent No.: US 6,186,438 B1
(45) Date of Patent: Feb. 13, 2001

(54) APPARATUS FOR POSITIONING A SMOOTHING ROLL MOUNTED SO AS TO BE DISPLACEABLE AND ADJUSTABLE DURING COIL FORMATION AGAINST THE REELING MANDREL OF A STRIP COILER

(75) Inventors: Josef Zeppenfeld, Olpe; Rainer Hoppe, Hilchenbach; Jürgen Grell, Neuss, all of (DE)

(73) Assignee: SMS Schloemann-Siemag Aktiengesellschaft, Düsseldorf (DE)

( * ) Notice: Under 35 U.S.C. 154(b), the term of this patent shall be extended for 0 days.

(21) Appl. No.: 09/328,132

(22) Filed: Jun. 8, 1999

(30) Foreign Application Priority Data

Jun. 9, 1998 (DE) ..... 198 25 723

(51) Int. Cl.[7] ..... B65H 18/26
(52) U.S. Cl. ..... 242/547
(58) Field of Search ..... 242/547, 540, 242/520

(56) References Cited

FOREIGN PATENT DOCUMENTS 3318031 11/1984 (DE) .
0026335 4/1981 (EP) .
0229528 7/1987 (EP) .
0391135 10/1990 (EP) .
0393519 10/1990 (EP) .
0736474 10/1996 (EP) .

OTHER PUBLICATIONS

Patent Abstracts of Japan, vol. 011, No. 180 (M–597), Jun. 10, 1987 & JP 62 009717 A (Mitsubishi Heavy Ind Ltd.) Jan. 17, 1987.
Patent Abstracts of Japan, vol. '999, No. 04, Apr. 30, 1999 & JP 11 019718 A (Kobe Steel Ltd), Jan. 26, 1999.

*Primary Examiner*—John Q. Nguyen
(74) *Attorney, Agent, or Firm*—Friedrich Kueffner

(57) ABSTRACT

An apparatus for positioning a smoothing roll which is mounted so as to be displaceable by a cantilever arm against the reeling mandrel of a strip coiler and to be adjustable particularly with a roll changing head against the reeling mandrel with the use of a force application unit. The roll change head includes a swivel arm which can be swivelled in a joint and is drivable to carry out a swivelling motion, wherein a steel roll is mounted at the free end of the swivel arm in a bearing, and an adjusting arm supporting the smoothing roll is mounted at the free end of the swivel arm, wherein the adjusting arm includes a force-controllable adjusting system for adjusting the smoothing roll against the strip coiler or the outer tube surface thereof, and wherein the force application unit for displacing the cantilever arm is a distance-controllable adjusting unit.

16 Claims, 2 Drawing Sheets

APPARATUS FOR POSITIONING A SMOOTHING ROLL MOUNTED SO AS TO BE DISPLACEABLE AND ADJUSTABLE DURING COIL FORMATION AGAINST THE REELING MANDREL OF A STRIP COILER

BACKGROUND OF THE INVENTION

1. Field of the Invention

The present invention relates to an apparatus for positioning a smoothing roll which is mounted so as to be displaceable by means of a cantilever arm against the reeling mandrel of a strip coiler and to be adjustable particularly with a roll changing head against the reeling mandrel with the use of force application means.

2. Description of the Related Art

When coiling thin strips, particularly aluminum strips, it is known in the art to place a smoothing roll during the entire coiling process against the reeling mandrel or on the strip coiler in order to prevent air inclusions and strip defects, so called couch defects.

Because of jumps of the roll due to a diameter increase at the strip beginning, the so-called layer jump, the roll rotates unsteadily and hammer-like vibrations of the entire roll arm occur. In the past, it was not possible to eliminate this disadvantageous phenomenon even by using springs and dampers.

DE 33 18 031 A1 discloses a method and an apparatus for controlling the pressure rollers of a strip coiler influenced by pressure medium-operated cylinders. In accordance with this known method, in which the pressure rollers serve to introduce and press the first and last strip layers against the reeling mandrel or the previously wound strip layers, the strip beginning of the entering strip is observed and monitored without contact during the formation of the first winding and its respective position is utilized for positioning the pressure rollers.

In the apparatus for carrying out this known method, optical sensors are provided for the contactless monitoring of the strip beginning and an optical sensor is arranged immediately following each pressure roller as seen in the travel direction. The method and the apparatus require complicated mechanical and control-technological elements, so that, particularly when a diameter change of each strip layer occurs in the area of the strip beginning, the generation of markings due to mass inertia of the pressure rollers on the strip surface are avoided. For this purpose, the pressure rollers are controlled in such a way that they are moved back each time by a distance corresponding to the strip thickness before the strip beginning which causes the diameter jump passes the rollers. The reeling mandrel is coupled to a pulse generator which interacts with a pulse counter which starts to operate after a contact of the strip beginning at the reeling mandrels without slip has been achieved. It has also been proposed to observe and monitor without contact the strip beginning of the entering strip when the first winding is formed and to utilize the respective position for positioning the pressure rollers.

EP 0 391 135 A2 discloses a method of reeling strip in reeling plants. Using the method for controlling the pressure roller adjustment of a strip coiler which has become known under the name step control, it is possible to coil even strips on the reeling mandrel without damage. For this purpose, it is proposed that the pressure rollers move the strip as closely as possible to the reeling mandrel without, however, applying pressure forces against the reeling mandrel, or that only the last pressure roller in the entry direction of the strip moves the strip against the reeling mandrel, while the remaining pressure rollers move the strip as closely as possible to the reeling mandrel without exerting any pressure forces against the strip or the reeling mandrel. The contact of the strip against the reeling mandrel without slip is achieved by a position-controlled spreading of the mandrel segments.

SUMMARY OF THE INVENTION

Therefore, starting from the prior art discussed above, it is the primary object of the present invention to provide a smoothing roll unit for a strip coiler which is of particularly simple construction and operates with high vibration damping, wherein the smoothing roll unit is suitable to be mounted without problems at the exit side of a rolling train for thin strips and particularly aluminum strips, and the unit can particularly be used for retrofitting such a rolling train.

In accordance with the present invention, the roll change head includes a swivel arm which can be swivelled in a joint and is drivable to carry out a swivelling motion, wherein a steel roll is mounted at the free end of the swivel arm in a bearing, and an adjusting arm supporting the smoothing roll is mounted at the free end of the swivel arm, wherein the adjusting arm includes a force-controllable adjusting system for adjusting the smoothing roll against the strip coiler or the outer tube surface thereof, wherein the force application means for displacing the cantilever arm is a distance-controllable adjusting unit.

In the construction according to the present invention, the smoothing roll unit is supported through an oscillating crank system preferably on the axis of the steel roller. A support of the oscillating crank and, thus, of the smoothing roller is realized by a support at a pressure-controlled hydraulic cylinder. This ensures a targeted contact force regulation of the smoothing roller.

In accordance with further developments of the invention, the distance-controllable adjusting system includes at least one hydraulic cylinder and especially pulsation dampers, for example, bladder-type pressure accumulators or bladder-type accumulators, are arranged in the area of the connections of the hydraulic force application means on the side of the piston and piston rods, wherein the pulsation dampers are arranged as closely as possible next to the hydraulic cylinders.

In accordance with a useful further development, the bladder pressure of the pulsation dampers is preferably adjusted to a fixed value while narrowing the pressure range. Consequently, since the natural oscillation frequency of the pulsation dampers is far outside of the oscillation frequency of the oscillation crank supporting the smoothing roller, a complicated regulating system for the oscillation damping of the pulsation damper is not necessary.

The support of the smoothing roller or the oscillation crank support thereof at a pressure-controlled hydraulic cylinders ensures a targeted contact force regulation, while commercially available pulsation dampers are used at the cylinder supply lines at the side of the piston and piston rod for compensating and damping the jump at the strip beginning.

In accordance with the invention, the adjustment of the cantilever arm is effected through distance regulation, particularly in accordance with the build-up of the coil whose diameter increases. Instead of using force-controlled hydraulic cylinders, the force-controlled adjustment of the oscillation crank with smoothing roller could also be effected by pneumatic cylinders or another spring-type damping system.

In accordance with another advantageous feature, the masses of the smoothing roller system which are not spring-supported can be reduced by about 50% by a targeted selection of the material, i.e., a change from previously steel to aluminum. This ensures a significantly better adherence of the smoothing roller on the coil which is being coiled up.

In accordance with another advantageous further development of the invention, the smoothing roller may be formed by a tubular casing of light metal, for example, AlCuMgPb, and may be surrounded by a lining of highly resistant synthetic material.

As a result of the configuration of the smoothing roller unit according to the present invention, a significant increase of the service life of the roller lining can be achieved and the oscillations which build up during operation are simultaneously optimized in this manner.

In accordance with another feature, the individual proportional valves, pressure valves, distance valves, throttling valves and locking valves are mounted in accordance with their function on valve blocks and the valve blocks are combined to form control columns and are arranged on a substructure.

In accordance with another advantageous feature, the force application means for displacing the cantilever arm is equipped with a clamping head.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
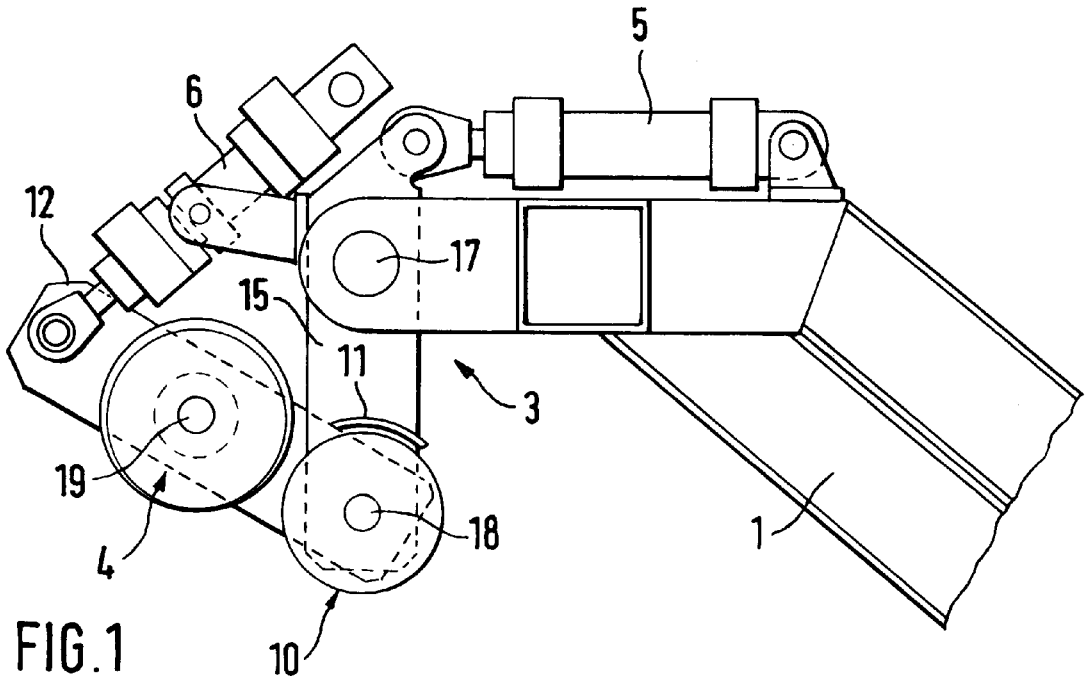
FIG. 1 is a schematic side view of a smoothing roller unit mounted at the end of a cantilever arm, shown in a position raised from the strip coiler.
Figure 2:
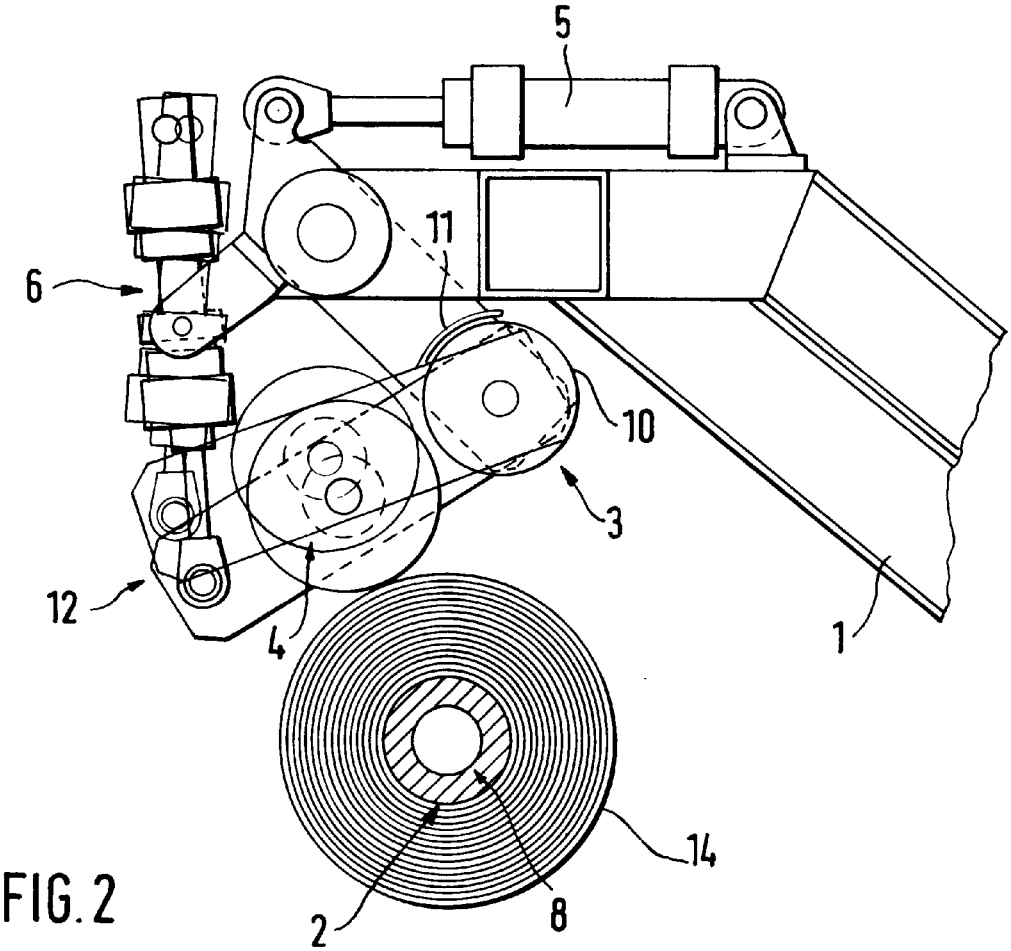
FIG. 2 is a schematic side view of the smoothing roller unit shown during rolling on the strip coiler.
Figure 3:
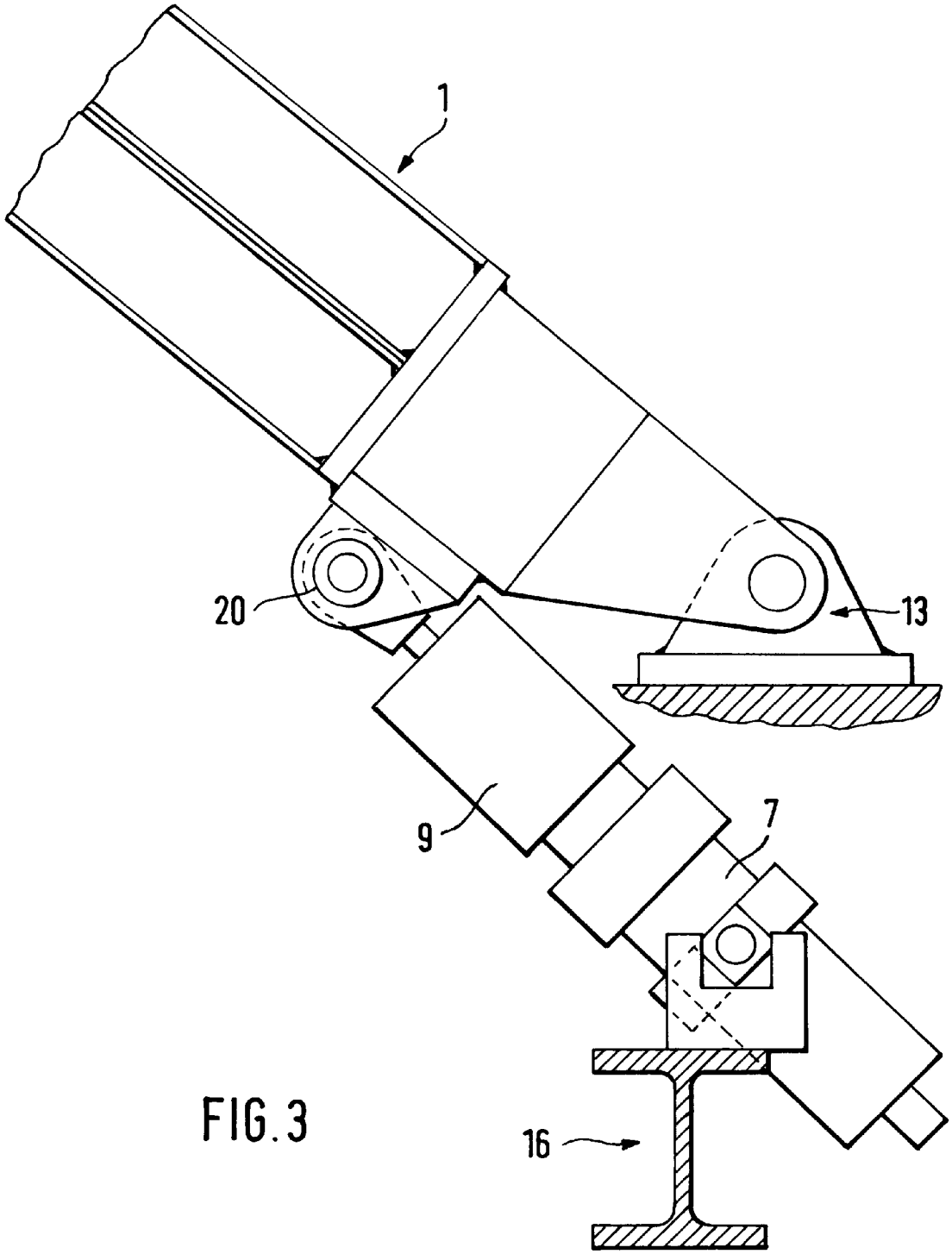
FIG. 3 is a side view showing the lower portion of a cantilever arm in an inclined position and supported by a hydraulic servo unit with clamping head.

FIGS. 1 through 3 of the drawing show the apparatus according to the present invention for positioning a smoothing roll 4 which is mounted so as to be displaceable by means of a cantilever arm against a reeling mandrel 2 of a strip coiler 14 and so as to be adjustable with a roll changing head 3 against the reeling mandrel 2 with the use of hydraulic force application means 5 to 7.

The roll changing head 3 includes a swivel arm 15 which can be swivelled in a joint 17 and can be driven by means of a hydraulic cylinder 5 to carry out a swivelling movement, wherein at the free end of the swivel arm 15 is mounted in a common bearing 18 a steel roll 10 and an adjusting arm 12 which supports the smoothing roll 4 with bearings 19. This swivel arm includes a force-controllable hydraulic unit 6 for adjusting the smoothing roll 4 against the strip coiler 14 or the outer tube surface 8 thereof. The force application means for displacing the cantilever arm is a distance-controllable hydraulic servo unit 7, shown in FIG. 3. The roll changing head is constructed in such a way that, depending on the angular position of the swivel arm 15, the roll changing head places either the smoothing roll 4 or the steel roll 10 in contact with the strip coiler 14.

The steel roll 10 is used at the strip end or as a holding brake in the case of ruptures of the strip; for this purpose, the steel roll 10 includes a braking device 11 which may be actuated, for example, pneumatically, while the smoothing roll 4 is placed in contact with the strip when coiling thin strips, particularly aluminum strips, during the entire coiling process in order to prevent air inclusions and, thus, strip defects (couch defects).

As already mentioned, the smoothing roll 4 is of a high-strength light metal, for example, AlCuMgPb. In contrast to previously known embodiments, the weight is reduced by approximately 50% and, thus, damping of the masses which tend to oscillate, i.e., masses which are not spring-supported, is optimized. The smoothing roll 4 may also have a tube casing 8 of light metal, for example, AlCuMgPb, with a lining of synthetic material.

As illustrated in FIG. 3, the force application means for displacing the cantilever arm 1, i.e., the hydraulic servo unit 7, is equipped with a clamping head 9. This clamping head 9 makes it possible to fixedly hold the cantilever arm 1 in a predetermined angular position. The hydraulic servo unit 7 is mounted, for example, on a stationary support 16. The cantilever arm 1 is held in an abutment 13 so as to be pivotable. The cantilever arm 1 and the hydraulic servo unit 7 are connected to a joint at 20. A joint connection 17 is also formed between the servo arm 15 and the hydraulic cylinder 6.

Using the smoothing roll unit described above, the cantilever arm 1 is initially moved in a position-controlled manner with the smoothing roll 4 in the direction toward the strip coiler 14. Once the smoothing roll is placed on the strip being coiled, the smoothing roll is pressed through the adjusting arm 12 in a force-controlled manner against the reeling mandrel 2 or against the strip being coiled.

In the case of strips having a greater thickness, prior to the entry of the strip beginning and prior to the next coil layer, the smoothing roll may be lifted in such a way that the gap formed between the pressure roller and the reeling mandrel or the coil exceeds the thickness of the already introduced strip by a dimension which exceeds the strip thickness and that, each time after the strip beginning has passed, the pressure roll is lowered in this position against the reeling mandrel into its position of operation.

While specific embodiments of the invention have been shown and described in detail to illustrate the inventive principles, it will be understood that the invention may be embodied otherwise without departing from such principles.

We claim:

1. An apparatus for positioning a smoothing roll mounted so as to be displaceable by a cantilever arm against a reeling mandrel of a strip coiler and adjustable by a roll changing head against the reeling mandrel using force application means, wherein the roll changing head comprises a swivel arm connected to a joint and drivable to carry out a swivelling motion, the swivel arm having a free end, wherein a steel roll is mounted at the free end of the swivel arm in a bearing, an adjusting arm for supporting the smoothing roll being mounted at the free end of the swivel arm, wherein the adjusting arm comprises a force-controllable adjusting system for adjusting the smoothing roll against the reeling mandrel, and wherein the force application means for displacing the cantilever arm comprises a distance-controllable adjusting unit.

2. The apparatus according to claim 1, wherein the force application means comprises at least one hydraulic cylinder for swivelling the swivel arm.

3. The apparatus according to claim 1, wherein the force controllable adjusting system for the smoothing roll comprises at least one of a hydraulic cylinder, a pneumatic cylinder and a spring-type damping system.

4. The apparatus according to claim 1, wherein the distance-controllable adjusting unit for the cantilever arm comprises at least one hydraulic servo unit.

5. The apparatus according to claim 1, wherein the force application means comprises connections at piston and piston rods, further comprising pulsation dampers mounted at the connections.

6. The apparatus according to claim 5, wherein the pulsation dampers are bladder-type accumulators.

7. The apparatus according to claim 5, wherein the pulsation dampers are arranged immediately adjacent the force application means.

8. The apparatus according to claim 5, wherein a bladder pressure of the pulsation dampers are adjusted to a fixed value so as to narrow a pressure range thereof.

9. The apparatus according to claim 1, wherein the smoothing roll is of a high-strength light metal.

10. The apparatus according to claim 9, wherein the high-strength light metal is AlCuMgPb.

11. The apparatus according to claim 1, wherein the smoothing roll is comprised of a tubular casing of light metal with a lining of synthetic material.

12. The apparatus according to claim 11, wherein the light metal is AlCuMgPb.

13. The apparatus according to claim 1, comprising individual proportional valves, distance valves, throttling valves and locking valves mounted on valve blocks in accordance with functions of the valves, wherein the valves are combined in control columns and are mounted on a substructure.

14. The apparatus according to claim 1, wherein the adjusting unit for displacing the cantilever arm is equipped with a clamping head.

15. A method for positioning a smoothing roll mounted so as to be displaceable by a cantilever arm against a reeling mandrel of a strip coiler and adjustable by a roll changing head against the reeling mandrel using force application means, wherein the roll changing head includes a swivel arm connected to a joint and drivable to carry out a swivelling motion, the swivel arm having a free end, wherein a steel roll is mounted at the free end of the swivel arm in a bearing, an adjusting arm for supporting the smoothing roll being mounted at the free end of the swivel arm, wherein the adjusting arm includes a force-controllable adjusting system for adjusting the smoothing roll against the reeling mandrel, and wherein the force application means for displacing the cantilever arm includes a distance-controllable adjusting unit, the method comprising moving the cantilever arm with the smoothing roll relative to the reeling mandrel using the distance-controllable adjusting unit and pressing the smoothing roll onto the reeling mandrel or the coil being coiled thereon using the force-controllable adjusting system.

16. The method according to claim 15, comprising, prior to a strip beginning entering and prior to any next winding layer passing, lifting the smoothing roll such that a gap formed between the roll and the reeling mandrel exceeds the thickness of the already entered strip by a dimension which exceeds the strip thickness, and lowering the smoothing roll after the strip beginning has passed against the reeling mandrel.

* * * * *